United States Patent [19]

Kopecky

[11] 4,313,717

[45] Feb. 2, 1982

[54] ADJUSTABLE PRESSURE EXTRUSION PUMP

[76] Inventor: Eugene F. Kopecky, 5959 Madra Ave., San Diego, Calif. 92120

[21] Appl. No.: 81,836

[22] Filed: Oct. 4, 1979

[51] Int. Cl.[3] ..... F04C 2/00; F04C 5/00

[52] U.S. Cl. ..... 418/48; 418/108; 418/153

[58] Field of Search ..... 418/48, 152, 153, 108

[56] References Cited

U.S. PATENT DOCUMENTS

| | | | |
|---|---|---|---|
| 3,084,631 | 4/1963 | Bourke | 418/48 |
| 3,857,654 | 12/1974 | Streicher | 418/48 |

FOREIGN PATENT DOCUMENTS

| | | | |
|---|---|---|---|
| 2425055 | 4/1975 | Fed. Rep. of Germany | 418/48 |
| 2505261 | 8/1976 | Fed. Rep. of Germany | 418/48 |
| 2529916 | 1/1977 | Fed. Rep. of Germany | 418/48 |
| 2646566 | 4/1978 | Fed. Rep. of Germany | 418/153 |
| 1269859 | 7/1961 | France | 418/48 |
| 602794 | 3/1960 | Italy | 418/48 |
| 652349 | 3/1979 | U.S.S.R. | 418/48 |

*Primary Examiner*—John J. Vrablik

*Attorney, Agent, or Firm*—Brown & Martin

[57] ABSTRACT

An extrusion pump for slurries and the like of the Moineau type includes an elastomeric stator that is detachably mounted in a radially adjustable housing for radially adjusting the pressure of the stator on the rotor therein.

3 Claims, 4 Drawing Figures

ADJUSTABLE PRESSURE EXTRUSION PUMP

BACKGROUND OF THE INVENTION

The present invention relates generally to pumps and pertains particularly to extrusion pumps.

Slurries of concrete, plaster and similar materials are difficult to pump with conventional impeller pumps. Such materials are typically handled by an extrusion pump, generally referred to as a Moineau pump, which includes a rigid cylinder or cylindrical housing in which is mounted an elastomeric pump stator in an unstressed condition. The stator includes a spiral interior bore corresponding to the external shape of an elongated spiral shaped rotor or impeller, which passes through the cylinder. The rotor is preferably formed of steel or the like, and upon rotation deforms the interior of the stator, so achieving a pumping action. Such pumps in accordance with the prior art are shown in U.S. Pat. No. 3,006,615 issued Oct. 21, 1961 to W. R. Mason, Jr., and U.S. Pat. No. 3,093,364 issued June 11, 1963 to Schoonover.

Such pumps have been, and are extensively used in the construction industry today. One drawback to such pumps is that the bore of the stator wears at a rapid rate requiring replacement quite frequently. Because of the structure this also requires, replacement of the housing of the pump section which as previously described generally comprises a cylindrical housing formed of a section of pipe on the order of three to four inches in diameter in which the elastomeric stator is molded. The frequent and continuous replacement of this unit becomes quite expensive over a period of time.

Another drawback to such prior art devices is the fact that as the stator bore wears the pressure of the pump begins to drop. Thus, a new pump stator assembly begins at optimum pressure with the pressure dropping off to a substantially unworkable pressure at the end of the life of the stator.

It is therefore desirable that means be available which reduces the cost of replacement of such pump units and reduces the pressure loss during its lifetime.

SUMMARY AND OBJECTS OF THE INVENTION

It is therefore the primary object of the invention to overcome problems of the prior art.

Another object of the invention is to provide an improved extrusion pump having a stator that is replaceable independent of the housing.

A further object of the invention is to provide an improved extrusion pump having a stator that is adjustable on the rotor to maintain or increase the pressure of the pump.

In accordance with the primary aspect of the present invention an extrusion pump includes an elastomeric stator that is detachably mounted in an adjustable housing such that the stator can be replaced independent of the housing and the housing is radially adjustable to adjust the pressure of the stator on the rotor, and thereby the pressure of the pump.

BRIEF DESCRIPTION OF THE DRAWINGS

The above and other objects and advantages of the invention will become apparent from the following description when read in conjunction with the drawings wherein.

DETAILED DESCRIPTION OF A PREFERRED EMBODIMENT

Figure 1:
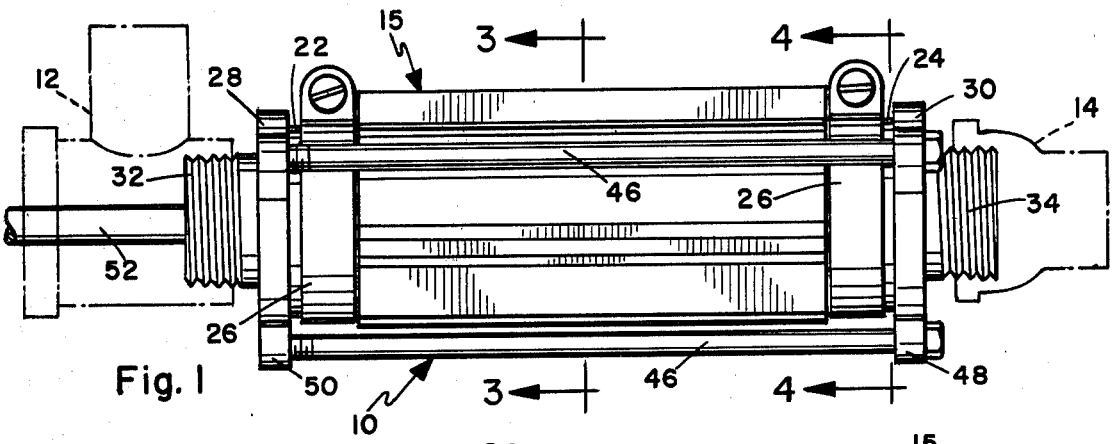
FIG. 1 is a side elevation view of the pump.
Figure 2:
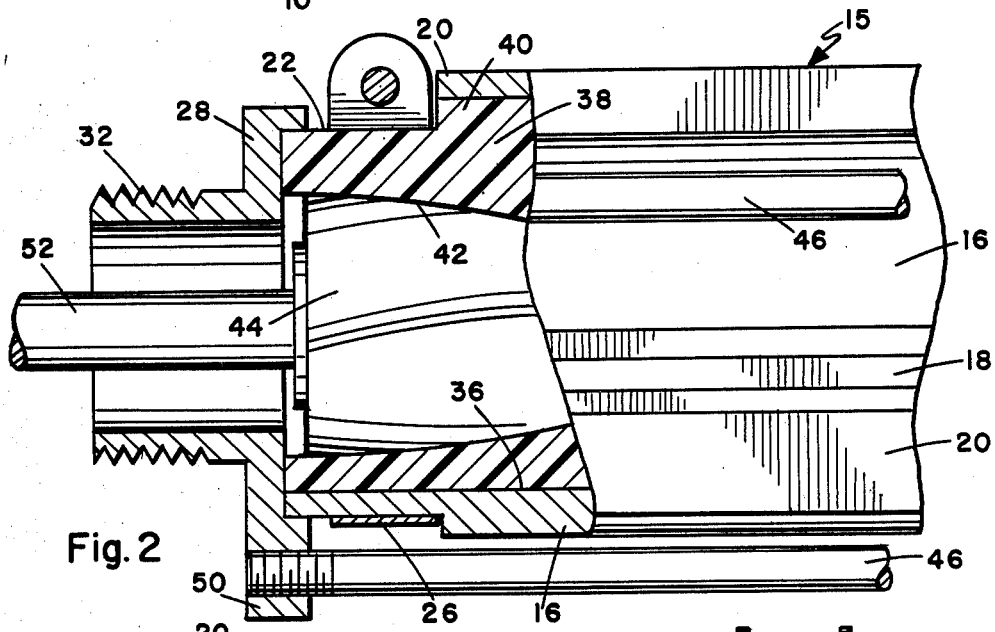
FIG. 2 is an enlarged side elevation view, partially cut away, of one end of the pump.

Turning now to the drawings, illustrated in FIG. 1 is a pumping unit designated generally by the numeral 10, showing an exemplary preferred embodiment of the invention. The unit as illustrated, replaces units as disclosed in the aforementioned Mason and Schoonover patents. The unit 10 is detachably mounted between an inlet chamber or hopper 12 shown in phantom. A slurry is fed into the pump unit at 12 and exits the unit at 14 and generally through a flexible hose or the like, and some form of nozzle or other spraying or application device, not shown.

Figure 3:
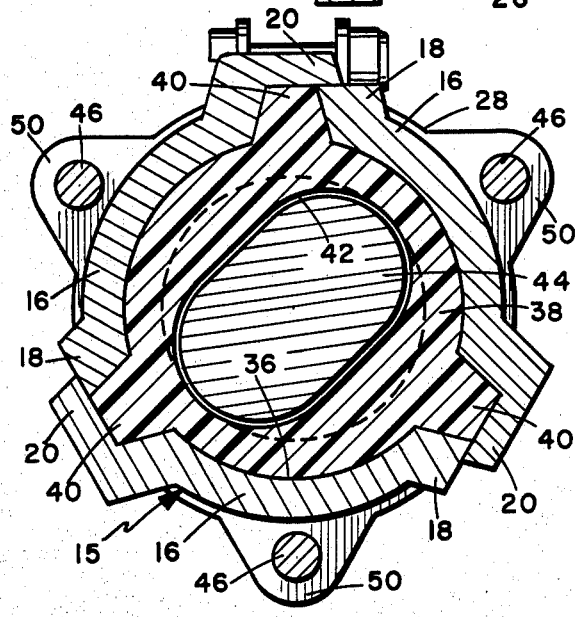
FIG. 3 is an enlarged sectional view taken on line 3—3 of FIG. 1.
Figure 4:
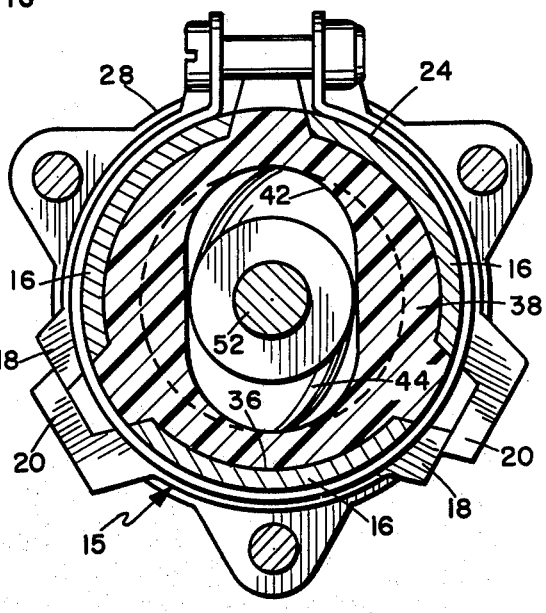
FIG. 4 is an enlarged sectional view taken on line 4—4 of FIG. 1.

The unit includes a generally cylindrical housing 15. The basic elements of the housing 15 are three identical segments 16 of a generally arcuate or semicircular configuration, each having a stub flange 18 extending along one edge, which cooperatively engages with a cap flange 20 along the opposite edge of an adjacent identical housing segment these flanges 18 and 20 are shaped as seen in FIGS. 3 and 4 to form a radially tapering adjustable width groove therebetween. The groove tapers down from a wider base near the center of the housing radially outwardly to a narrower outer edge at the inner surface of the cap flange. The ends of each housing segment are formed or shaped with cylindrical outer surfaces or sections 22 and 24, for the purpose of receiving a pair of identical circular or band clamps 26. These end portions additionally provide means for receiving end caps or adapters 28 and 30, each including a threaded cylindrical portion 32 and 34 respectively, for fitting into the inlet and outlet sections 12 and 14 of the pump system or assembly. Thus, the unit replaces the conventional pipe section having a fixed molded liner of the prior art.

The housing 15 as best seen in FIGS. 3 and 4 has an inner, generally cylindrical chamber defined by an inner arcuate surface 36 of the sections. The sections with the flange construction form a generally cylindrical chamber having a tapered longitudinal groove or slot along the edge (i.e. formed between the flanges) of each adjacent section, for receiving a replaceable, generally cylindrical liner 38 having a plurality of ribs 40 extending along the length thereof on the outer surface. These ribs having a height of about the minimum thickness of the liner and extend between the flanges of the adjacent sections of the housing and are gripped therebetween for retaining the liner in the housing to prevent rotation thereof. The liner is thus detachably mounted within the housing and is easily replaceable. The housing is held together around the inner lining 38 and is adjustable therewith by means of the clamps 26.

The inner lining 38 is of an elastomeric material and is formed with a helical shaped bore 42 extending the length thereof. The preferred form is that of a double helix, although a single or multiple helix can be used. The liner is preferably constructed of a resilient, abrasion resistant material such as molded rubber or polyurethane, or similar plastic materials. The shore hardness of the material can be selected for different applications and for optimum wear pressure adjustment and the like.

A pumping rotor 44, also having a helical configuration, is mounted within the helical bore 42 of the resilient liner 38. This rotor rotates within the liner relative to the liner deforming the liner imparting pumping action to fluidized medium within the pump chamber. A drive shaft 52 is drivingly connected to the rotor 44 and is connected to a suitable source of power such as a prime mover.

As the bore of the liner wears, the pressure developed in the pump gradually reduces along with the gradual wear of the liner. With the present invention, however, the radial dimensions of the bore 42 may be continually adjusted radially inward over a large range of adjustment to maintain a higher pressure within the pump. This radial compression adjustment of the liner is accomplished by adjustably tightening the clamps 26 on the outer housing, thus pulling segments 16 of the housing inward for adjustment of the liner. Because of the construction of the housing and the liner itself the segments are pulled inward at an equal rate and the ribs 40 of the liner squeezed between the tapered side walls of the flanges 18 and 20 displacing the ribbed material radially inward toward the access of the liner which results in a uniform, substantially equal adjustment [of the bore] of the liner. Once the maximum adjustment of the liner has been utilized, the liner is removed and a new liner is placed in the housing.

The end caps 28 and 30 are held in place by a plurality of elongated bolts 46 which extend through the bore in lugs 48 on the end cap 30 and threadably engage bores in lugs 50 on the end cap 28.

With the present invention the manufacture of the combined liner and housing as in the prior art is eliminated. Each machine is provided with a simple, single, adjustable housing unit 10 which replaces the conventional combined stator and housing unit. Replaceable liners are then manufactured to fit the housing and only the liner need be replaced when excessive wear has occurred. This considerably reduces maintenance costs of such units since only the liner itself need be manufactured after the initial housing or a single housing unit has been supplied.

The present invention provides the additional feature of the adjustability which not only increases the life of the particular inserts or liners, but also provides the capability of adjusting the pressure output of the pump.

In order to replace a liner, the housing unit may simply be removed from the pumping unit, taken apart and the liner replaced. The entire unit may be removed, or simply the center section. The center section may be removed by removing bolts 46 and separating the end caps 28 and 30. The clamps 26 may then be removed and the liner 38 removed from inside the segments of the housing and discarded. A new liner is then inserted in place and the clamps 26 again placed around the housing segments and secured in place. Appropriate adjustment then may be accomplished by adjusting the clamps 26 to achieve the desired pump pressure.

While I have illustrated and described my invention by means of specific embodiments, it is to be understood that numerous changes and modifications may be made therein without departing from the scope of the invention as defined in the appended claims.

I claim:

1. An adjustable cavity pump comprising:

an elongated housing consisting of three identical elongated arcuate housing segments defining a generally cylindrical chamber;

said segments each include a stub flange extending outward from the outer surface and extending along one longitudinal edge and a cap flange spaced outward from the outer surface and extending along the other longitudinal edge, the stub and cap flanges on the adjacent segments cooperatively engaging with the cap flange overlapping the stub flange for defining an adjustable width longitudinal groove tapering outwardly on both sides of the groove to a narrower width at the juncture of the flanges of adjacent housing segments and having a depth exceeding the thickness of said segment extending the length of the cylindrical cavity and for guiding said housing segments radially inwardly and outwardly, an elongated elastomeric stator having a helical bore for receiving a helical rotor and detachably mounted in said chamber, and including a plurality of radially extending lugs having a radial dimension of about the minimum thickness of said stator engaging said grooves for preventing rotation of the stator and for transferring circumferential displacement of said flanges to radial displacement of said lugs inwardly, and said housing including band clamp adjusting means for adjusting said housing segments radially inwardly and outwardly for adjusting the diameter of said helical bore.

2. The adjustable cavity pump of claim 1 including a pair of end caps detachably mounted on said housing unit for defining and including inlet and outlet ports for the pump chamber.

3. The adjustable cavity pump of claim 2, wherein said housing includes a substantially cylindrical outer surface at each end thereof and said clamping means includes a band clamp extending around each of said cylindrical surfaces, and each of said clamps being independently radially adjustable for independently adjusting each end of said helical bore.

* * * * *